United States Patent [19]

Jessop

[11] Patent Number: 4,965,050

[45] Date of Patent: Oct. 23, 1990

[54] ADAPTATION OF PIPETTER

[75] Inventor: Paul M. Jessop, Salt Lake City, Utah

[73] Assignee: Ballard Medical Products, Midvale, Utah

[21] Appl. No.: 299,708

[22] Filed: Jan. 18, 1989

[51] Int. Cl.[5] ..... B01L 3/02

[52] U.S. Cl. ..... 422/100; 422/103; 73/864.14; 73/864.59

[58] Field of Search ..... 422/99, 100, 103, 310; 73/864.14, 864.59

[56] References Cited

U.S. PATENT DOCUMENTS

| | | | |
|---|---|---|---|
| 4,023,716 | 5/1977 | Shapiro | 73/864.14 X |
| 4,151,750 | 5/1979 | Suovaniemi et al. | 73/864.14 |
| 4,283,950 | 8/1981 | Tervamaki | 422/100 X |
| 4,391,779 | 7/1983 | Miskinis | 422/102 X |
| 4,395,382 | 7/1983 | Miskinis | 422/103 |
| 4,785,677 | 11/1988 | Higo | 422/100 X |

OTHER PUBLICATIONS

Eppendorf Veripette 4710 Instruction Manual.

*Primary Examiner*—Robert J. Warden
*Assistant Examiner*—Lynn M. Kummert
*Attorney, Agent, or Firm*—Lynn G. Foster

[57] ABSTRACT

An adapter, and related method, by which a specialized commercially available pipetter heretofore requiring an expensive custom pipette tip may be used with a standard pipette tip which is ejected from the pipetter by actuation of the adapter.

9 Claims, 2 Drawing Sheets

ADAPTATION OF PIPETTER

FIELD OF INVENTION

The present invention relates generally to pipetters used to transfer a quantity of liquid specimen or sample from one site to another, and, more particularly, to the adaptation of certain tip size restrained custom pipetters for acceptance of differently sized or standard disposable pipette tips.

PRIOR ART

Certain manually-actuated pipetters are custom manufactured for use with a specific type of specialized disposable pipette tip. Thus, such pipetters are tip size-restrained and will not universally work with a variety of pipette tips. This presents serious problems. First, the end user is forced to pay a premium price for customized disposable tips used in medical and related laboratory fields where costs are already of serious concern and sometimes deprive members of the public of much needed help. Secondly, if the supply of specialized or custom tips become exhausted, other tips will not function and the delay in acquiring more specialized tips undesirably postpones testing and treatment or analysis based on test results. It may also create a risk that the specimen will no longer be representative or useful when later tested. This may necessitate the taking of an additional sample from the patient, sometimes causing substantial trauma and, in some cases, creating a risk of death or injury.

For example, the Eppendorf Varipette #4710 pipetter, very popular in the industry, requires a pipette tip which is dimensionally sized at the proximal end thereof to fit a known distance upon the pipetter. Thus, when a more conventional or standard tip, having a differently sized proximal portion, is used, the standard tip fits upon the pipetter through a shorter overlapping distance. Thus, ejection of the conventional tip does not occur during full advance of the actuator.

BRIEF SUMMARY AND OBJECTS OF THE INVENTION

In brief summary, the present invention overcomes or substantially alleviates the aforesaid limitations of the prior art and provides for the adaptation of pipetters, heretofore requiring custom pipette tips, for use with and ejection of standard pipette tips whereby the pipetters have a more universal application, costs are reduced and delays in specimen testing are avoided.

With the foregoing in mind, it is a primary object of the present invention to overcome or alleviate problems of the prior art by providing for the adaptation of specialized pipetters, heretofore requiring custom tips, for use with and ejection of standard pipette tips.

A further paramount object is the provision of an adapter for specialized pipetters to accommodate interfitting of disposable standard pipette tips to broaden the potential scope of use of the pipetter, to promote cost savings and to avoid delays in specimen testing.

These and other objects and features of the present invention will be apparent from the detailed description taken with reference to the accompanying drawings.

DETAILED DESCRIPTION OF THE ILLUSTRATED EMBODIMENT

Figures 1, 2, 7:
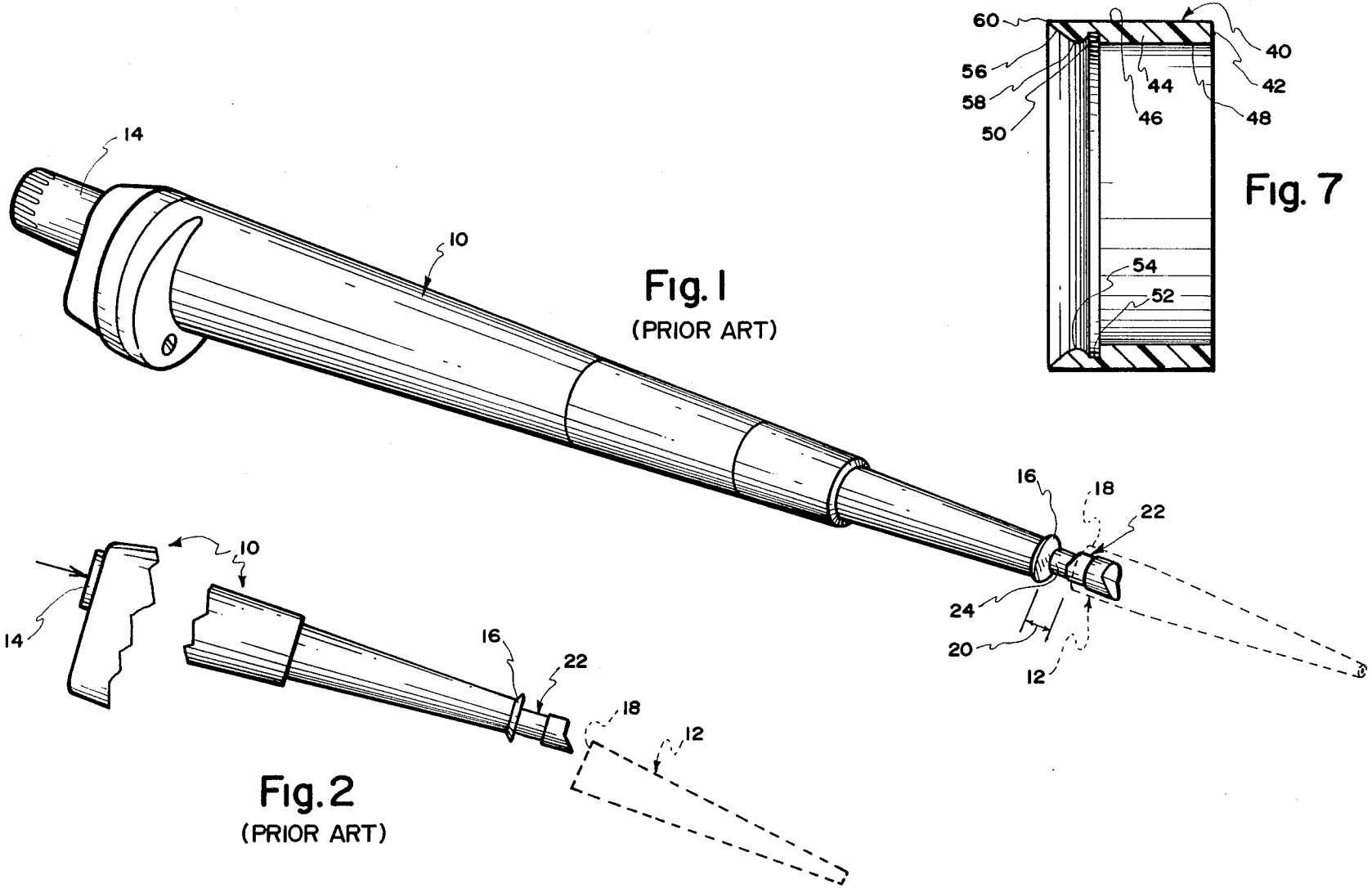
Fig. 1 (PRIOR ART)
Fig. 2 (PRIOR ART)
FIG. 1 is a front elevational view of a prior art specialized pipetter in its at rest position, with the proximal actuator in its fully extended position, upon which a custom pipette tip, shown in dotted lines, has been press-fitted.
FIG. 2 is a fragment front elevational view of the prior art pipetter of FIG. 1 with the actuator depressed causing the custom pipette tip to be ejected from the distal end of the pipetter.
FIG. 7 is a cross-section of the ring adapter taken along lines 7—7 of FIG. 4.

Reference is now specifically made to the drawings where like numerals are used to identify like parts throughout. FIGS. 1 and 2 are directed toward the prior art and illustrate a commercially available manually-actuatable pipetter, generally designated 10, upon which a specialized or custom disposable pipette tip, shown in dotted lines and generally designated 12, may be press-fitted, as illustrated in FIG. 1, and ejected, as illustrated in FIG. 2. The pipetter 10 comprises a proximally-disposed manual actuator 14, shown in its fully extended unstressed non-actuated position in FIG. 1 and in its thumb-depressed actuated or fully advanced position in FIG. 2. The pipetter 10 comprises internal works for aspirating a volumetric sample or specimen into and discharging the same from the interior of the custom pipette tip 12, which need not be described here because such is conventional and well known to those skilled in the pipetter manufacturing art.

The pipetter 10 comprises a radially-extending distally disposed enlarged flange 16, which is rectilinearly displaceable with the full rectilinear actuation of actuator 14. Thus, the flange 16 is located in the position of FIG. 1 when the pipetter 10 is nonactuated or at rest, where it is spaced from the proximal edge 18 of the custom pipette tip 12 by a distance 20 substantially less than the full travel of actuator 14. When the actuator 14 is fully depressed to the position of FIG. 2, the proximal edge 18 is first engaged and then displaced by the flange 16 until the custom pipette tip 12 is separated from the distal end of the pipetter 10. Normally, this separation, as shown in FIG. 2, is achieved over a waste-receiving container (not shown).

The pipetter comprises a distal fitting 22 integrally carried at the distal end of a shaft 24 and is sized and shaped to be snugly and sealingly received through the proximal opening of the pipette tip 12 adjacent edge 18.

Figure 3:
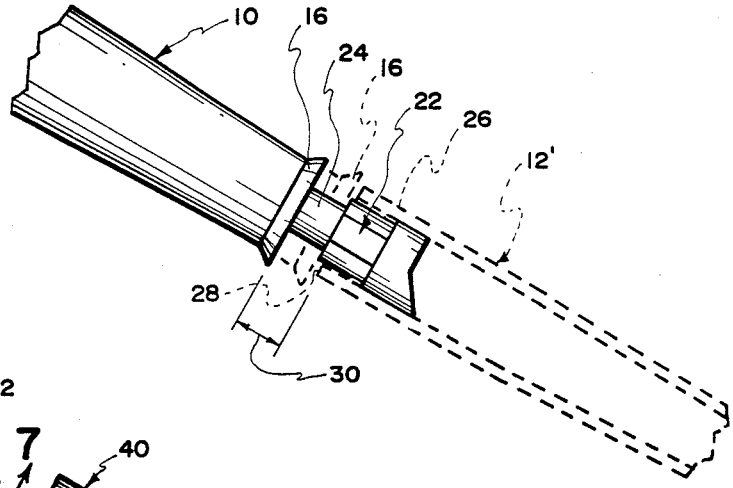
FIG. 3 is a fragmentary front elevation of the distal end of the prior art pipetter of FIG. 1 upon which a standard pipette tip has been force-fitted, showing the at rest position of the distal end of the pipetter in solid lines the non-ejecting actuated position in dotted lines.
Figure 4:
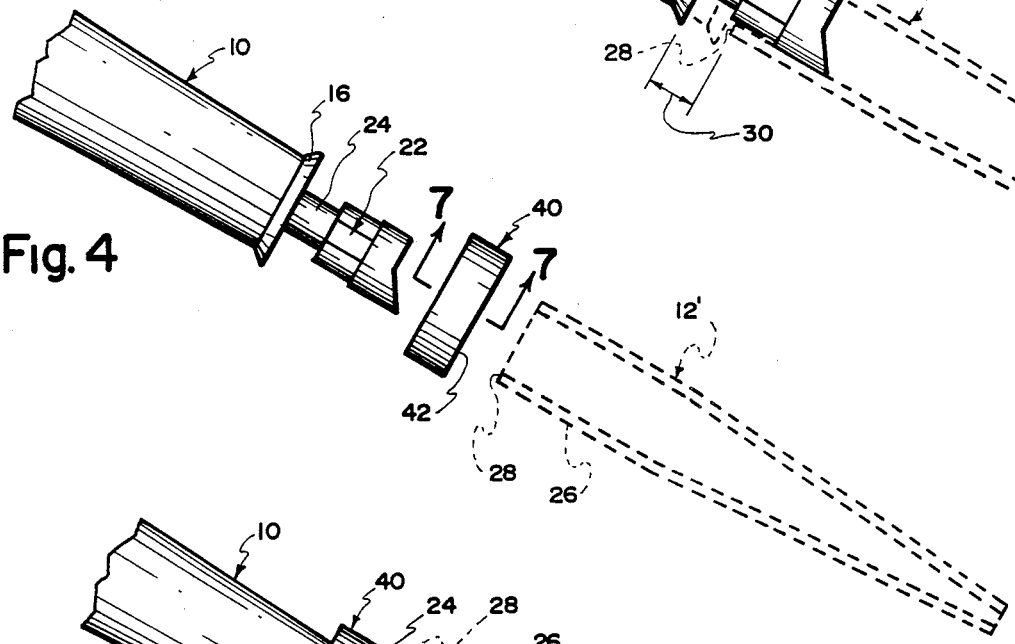
FIG. 4 is an exploded fragmentary front elevational view of the distal end of the pipetter of FIG. 1, a ring adapter and the proximal end of a standard pipette tip.

FIG. 3 illustrates the consequence of placing a standard pipette tip 12' in snug, sealed and press-fitted relation upon the distal fitting 22 of the pipetter 10. Specifically, the proximal region 26 ending in edge 28 is dimensionally different than the corresponding proximal region of custom tip 12. Stated differently, with the standard tip 12′ fully inserted upon the fitting 22 the distance 30 (FIG. 3) is substantially greater than the distance 20 in FIG. 1. Therefore, when the actuator 14 is totally depressed moving the flange 16 from the solid to the dotted position, edge 28 is not engaged and tip 12′ is not ejected.

To overcome the problem identified above in conjunction with FIG. 3, an adapter ring, generally designated 40, is provided. See FIGS. 4–7. The adapter ring 40 is internally-shaped to be force-fitted upon and carried by flange 16 during its reciprocal travel. The axial length of the adapter ring 40 is such that, when installed upon pipetter 10, the distance from the distal edge 42 thereof to the proximal edge 28 of the standard tip 12′ is essentially the same as the earlier described distance 20. The diametral size of the edge 42 is such that it is aligned with edge 28 for ejective engagement of the two.

More specifically, with reference to FIG. 7, the adapter ring 40 comprises an annular wall 44, which is substantially of uniform thickness throughout. Wall 44 comprises smooth exterior cylindrical surface 46 and a concentrically parallel smooth interior cylindrical surface 48. Surfaces 46 and 48 are connected by blunt edge 42 at the distal end of the adapter ring 40.

Figure 5:
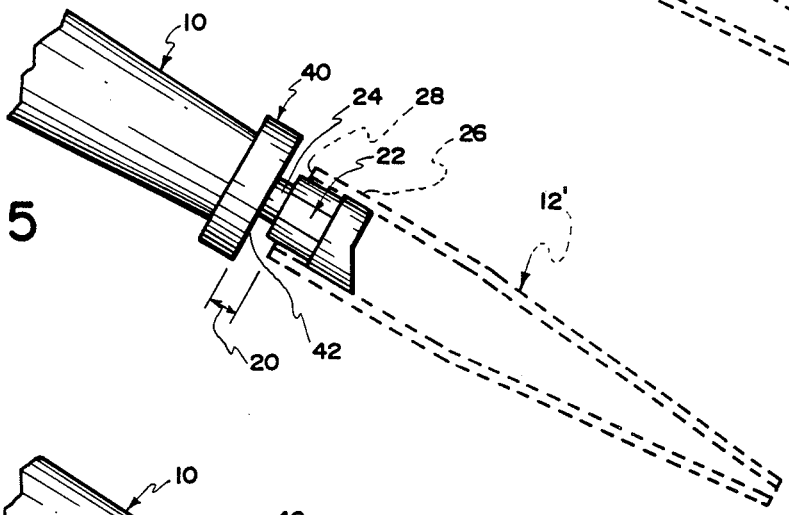
FIG. 5 is a fragmentary front elevation of the combination of FIG. 4 with the components thereof assembled and the distal end of pipetter retracted.
Figure 6:
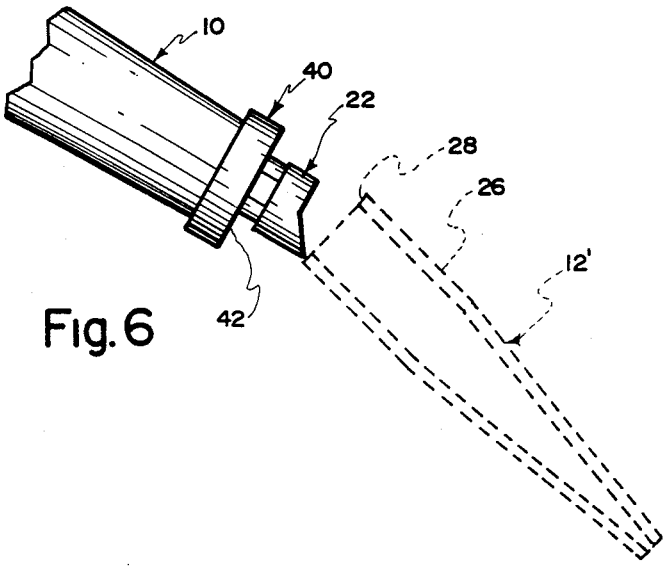
FIG. 6 is similar to FIG. 5 but with the distal end of the pipette extended so the ring adapter ejects the standard micro pipette tip.

The interior surface 48 is interrupted by enlarging radially-directed shoulder 50 at the proximal portion thereof. Shoulder 50 restrains the flange 16 against distally-directed relative displacement in respect to the adapter ring 40, when assembled as shown in FIGS. 5 and 6. Shoulder surface 50 merges with an annular slot-defining surface 52, which has a diameter less than surface 46, preferably slightly less than the diameter of flange 16 and greater than surface 48. Surface 52 merges with a convergently tapered surface 54, which joins a divergently tapered surface 56 at rounded apex 58. Surface 56 angularly joins surface 46 at proximal edge 60.

The surfaces 54 and 56 and apex 58 are sized and shaped to allow force-fitting of the adapter ring 40 upon the flange 16 to, in effect, extend the flange distally. The diameter of flange 16 allows for displacement of the ring 40 a short distance over the flange 16 until the flange 16 is contiguous with the surface 56. Axially-imposed opposite forces upon the flange 16 and the ring 40 toward each other thereafter causes the ring 40 to distend radially as it rides over the flange 16, along the surface 56 and over the apex into the slot existing between surfaces 50, 52 and 54. The diametral relationship between flange 16 and surface 52 is preferably such that a slightly compressive interrelationship is created. The ring 40 is thus held against inadvertent separation from the flange 16, although the ring 40 can be forceably removed from the flange 16 by manual force, as may be desired from time-to-time by the user when shifting between custom and standard pipette tips.

With the adapter ring 40 installed upon flange 16, as explained above, standard disposable tip 12′ is axially inserted upon pipetter fitting 22 in force-fitted, sealed relation. The conventional liquid transfer steps are practiced, following which the actuator 14 of the pipetter 10 is fully depressed to cause the edge 42 of the adapter ring 40 to engage the edge 28 of the standard tip 12′ and to displace the tip 12′ distally relative to the fitting 22 until the tip is ejected. In other words, the adapter ring 40 is caused to be displaced from the position of FIG. 5 to that of FIG. 6.

The invention may be embodied in other specific forms without department from the spirit or essential characteristics thereof. The present embodiment is, therefore, to be considered in all respects as illustrative and not restrictive, the scope of the invention being indicated by the appended claims rather than by the foregoing description, and all changes which come within the meaning and range of equivalence of the claims are therefore to be embraced therein.

What is claimed and desired to be secured by United States Letters Patent is:

1. A method of adapting a custom pipetter, designed to be used with a custom disposable pipette tip having predetermined dimensional characteristics, for use with a disposable standard pipette tip having a dimensionally shorter proximal section comprising the steps of:

providing the custom pipetter having an actuator, a distal fitting for releasibly and sealingly receiving a custom pipette tip and a distal ejector for ejecting the custom pipette tip from the distal fitting, the distal fitting and the ejector being spaced when at rest by a predetermined distance which prohibits ejection of a standard pipette tip;

providing an adapter for the pipetter;

connecting the adapter to the ejector prior to pipetter use to in effect shorten the predetermined distance by a known amount;

placing a disposable standard pipette tip upon the distal fitting in lieu of such placement of a custom pipette tip;

transferring liquid specimen from one location to another using the standard pipette tip and the pipetter;

thereafter selectively displacing of the actuator of the pipetter to cause the adapter to contiguously engage, displace and eject the disposable standard pipette tip.

2. A pipetter device comprising in combination:

a pipetter comprising actuator means, distal fitting means and distal first pipette tip ejector means spaced proximally of the distal fitting means by a first predetermined distance when the actuator means are at rest, the distal first pipette tip ejector means being relatively displaceable a distance short of the distal fitting means responsive to displacement of the actuator means;

adapter means comprising second pipette tip ejector means and means by which the adapter means are selectively releasibly connected to the first ejector means so that the second pipette tip ejector means is spaced proximally of the distal fitting means by a second lesser predetermined distance whereby a pipette tip, having a proximal region dimensionally shorter than that with which the pipetter is capable of functioning without the adapter means, placed upon the distal fitting means will, in conjunction with the pipetter, accommodate transfer of a liquid specimen and thereafter will be ejected from the distal fitting means by contiguous contact by the second ejector means due to relative displacement of the adapter means responsive to manual displacement of the actuator means.

3. A combination according to claim 2 wherein the distal fitting means comprise an enlargement at the distal end of a shaft.

4. A combination according to claim 2 wherein the distal fitting means comprise flange means.

5. A combination according to claim 2 wherein the actuator means comprise a thumb displacement button disposed at the proximal end of the pipetter.

6. A combination according to claim 2 wherein the releasibly connected means comprise force-fit means.

7. A combination according to claim 2 wherein the adapter means comprises a ring-shaped configuration.

8. A combination according to claim 2 wherein the second ejector means comprise annular extension means.

9. A pipetter device comprising in combination:

a hand held pipetter comprising actuator means, distal fitting means and a housing comprising distal first pipette tip ejector means spaced proximally of the distal fitting means by a first predetermined distance when the actuator means are at rest, the distal first pipette tip ejector means being relatively displaceable a distance short of the distal fitting means responsive to displacement of the actuator means;

adapter means comprising second pipette tip ejector means, the adapter means comprising connection means by which the pipetter is selectively connected to the adapter means, the adapter means when so connected being spaced proximally of the distal fitting means by a second lesser predetermined distance whereby a disposable pipette tip having a proximal end region dimensionally spaced from the distal fitting means a distance greater than the displaceable distance may be placed upon the distal fitting means of the pipetter to transfer a liquid specimen and to thereafter be ejected from the pipetter by the second ejector means due to relative displacement of the connected adapter means responsive to displacement of the actuator means.

* * * * *